United States Patent [19]

Clausing

[11] 4,160,142

[45] Jul. 3, 1979

[54] CIRCUIT BREAKER MAIN AND DISCONNECT CONTACT STRUCTURE

[75] Inventor: Charles I. Clausing, Marlton, N.J.

[73] Assignee: Gould Inc., Rolling Meadows, Ill.

[21] Appl. No.: 869,857

[22] Filed: Jan. 16, 1978

[51] Int. Cl.[2] ..... H01H 1/50; H01H 3/00

[52] U.S. Cl. ..... 200/254

[58] Field of Search ..... 200/254, 255, 282, 162, 200/163

[56] References Cited

U.S. PATENT DOCUMENTS

| | | | |
|---|---|---|---|
| 2,345,034 | 3/1944 | Crabbs | 200/255 |
| 2,751,471 | 6/1956 | Wills | 200/254 |
| 3,427,419 | 2/1969 | Findley, Jr. | 200/255 |

*Primary Examiner*—Richard E. Aegerter
*Assistant Examiner*—Willis Little
*Attorney, Agent, or Firm*—Ostrolenk, Faber, Gerb & Soffen

[57] ABSTRACT

Modular contact elements are provided for a circuit breaker wherein the stationary main contacts and the disconnect contacts may all be constructed of pairs of contact jaws, each of the jaw elements being identical to the others, thereby facilitating manufacturing and assembly procedures. Various different members of sets of contact jaws may be used for each of the stationary and disconnect contacts depending on the rating and capacity of the circuit breaker. In high capacity circuit breakers the internal upper bus or current carrying bar which carries the stationary contacts and lower bar which carries the movable contact or bridging blade may each be provided with separate supports at the rear end for a plurality of parallel sets of disconnect contact jaws to cooperate with a corresponding plurality of disconnect contacts; the front end of the upper bar may be provided with separate supports for a plurality of parallel sets of stationary contacts to cooperate with a corresponding plurality of movable contact or bridging blades connected to supports at the front end of the lower bar. The front of the upper bar above the stationary contact structure and an upward extension of the movable contact or bridging blade carry complementary arcing contacts. The blade is electrically integrated rotatably with front of the lower bar by spring washers at the pivot area.

20 Claims, 14 Drawing Figures

10
10
20
24
24
30
31
32
200
201
201
210
230
231
232
233
240
241
242
245
110
110a
110b
110c
110d
112
112a
112b
112c
112d
120
121
122
125
125a
130
131
132
133
135
136
140
141
150
160
161
162
163
164
165
170
171
172
180
400
401

CIRCUIT BREAKER MAIN AND DISCONNECT CONTACT STRUCTURE

BACKGROUND OF THE INVENTION

The present invention relates to circuit breakers and more particularly to contact structure therefor.

In the construction of circuit breakers, especially those which are to be racked into and out of cubicles, the stationary contacts of the circuit breakers and the disconnect contacts have been of different size and construction. Also, in circuit breakers of the same general class, the contacts have been different in size and structure for circuit breakers having various capacities.

A primary object of the present invention is the provision of modular contact elements for circuit breakers wherein contact structures for the circuit breakers and the disconnect contact structures may be made up of a plurality of identical elements.

A further and important object of the present invention is the utilization of such modular contacts in various multiples, utilizing a large number of such modular contacts for circuit breakers of larger capacity and a smaller number for circuit breakers of lower capacity.

Another object of the present invention is the provision of a novel contact structure wherein individual elements having the same structure may be utilized in reversed position with respect to each other to form contact jaws and wherein a plurality of pairs of such contact jaws may be used in accordance with the current carrying requirements of the circuit breaker.

Another object of the present invention is the formation of a movable contact bridge hinged at one end and engageable with the foregoing contact jaws at the other end wherein said movable contact bridge is formed of a plurality of stamped plates including an extended plate carrying an arcing contact.

Another object of the present invention is the provision of current conducting high pressure bosses at the hinged end of the movable contact bridge to transfer current thereto.

The foregoing and other objects of the present invention will become apparent from the following description and drawings, in which.

Figure 3:
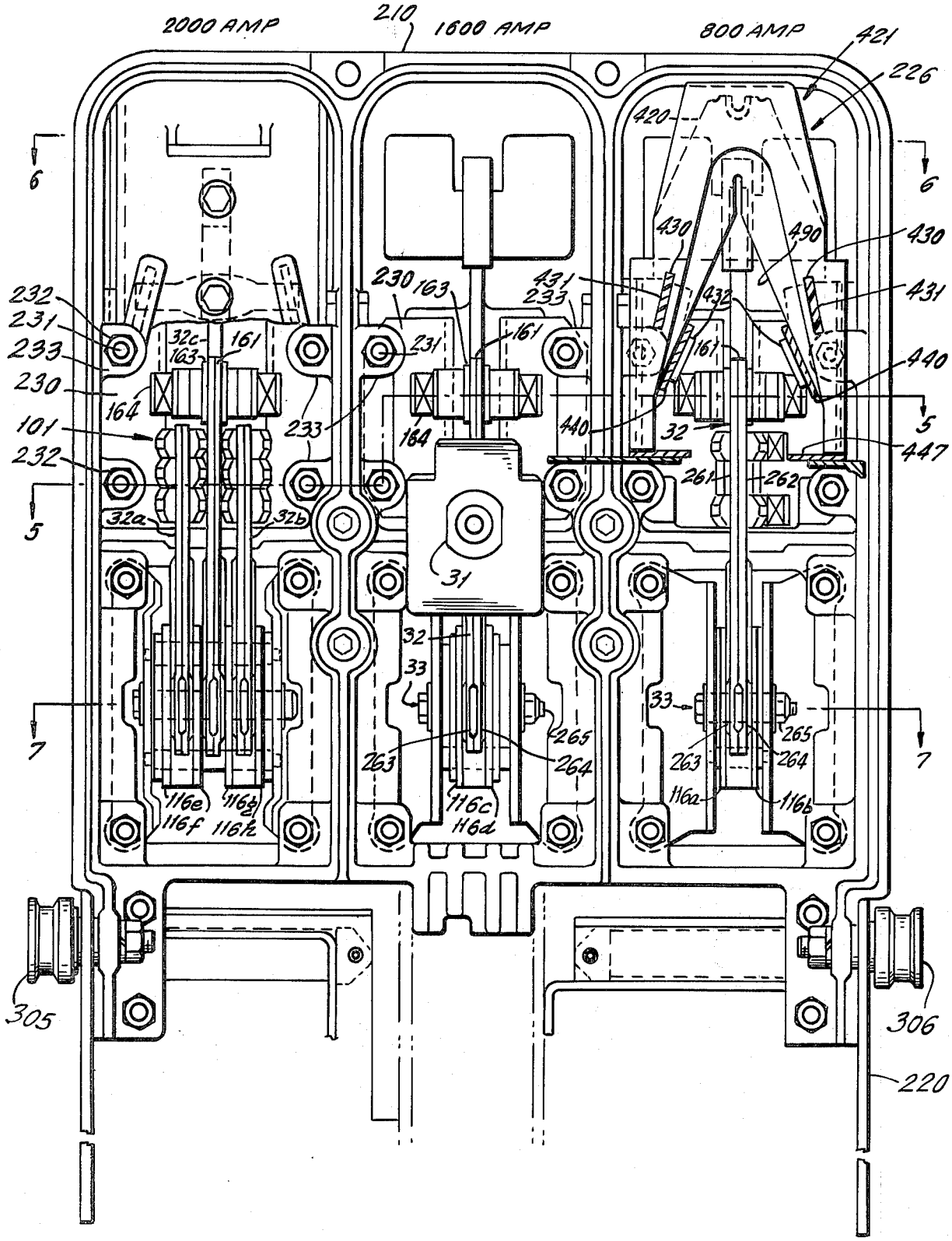

FIG. 3 is a front view of a plurality of different types of circuit breaker poles assembled together into a single housing for the purpose, only, of demonstrating that circuit breaker poles of varying capacity can be used within the same geometric outline of the breaker. All poles of any one circuit breaker will be of the same rating; in this case, the three different types of poles are shown only to demonstrate the versatility of the present device.

Figure 4:
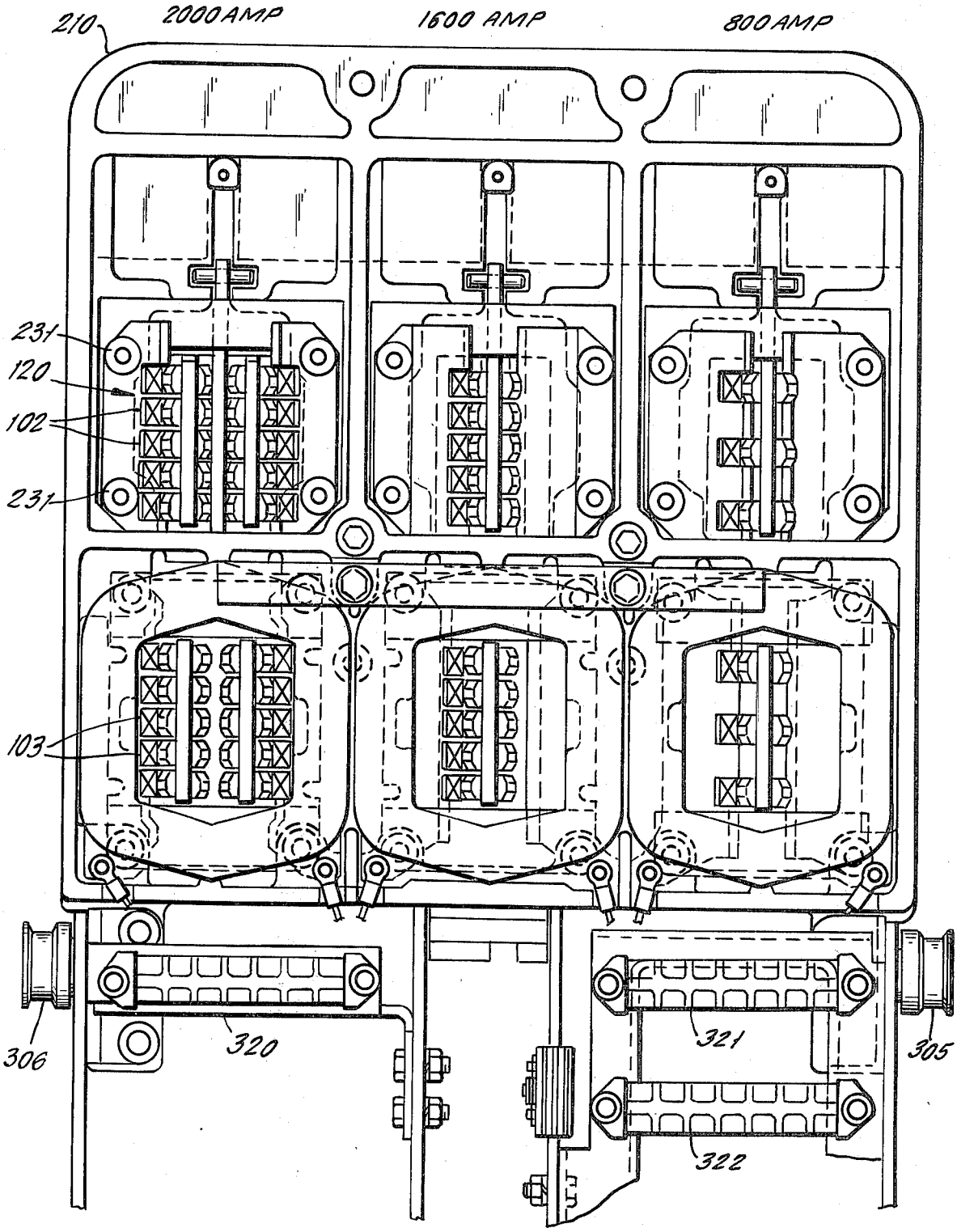

FIG. 4 is a rear view of the structure of FIG. 3.

Figure 5:
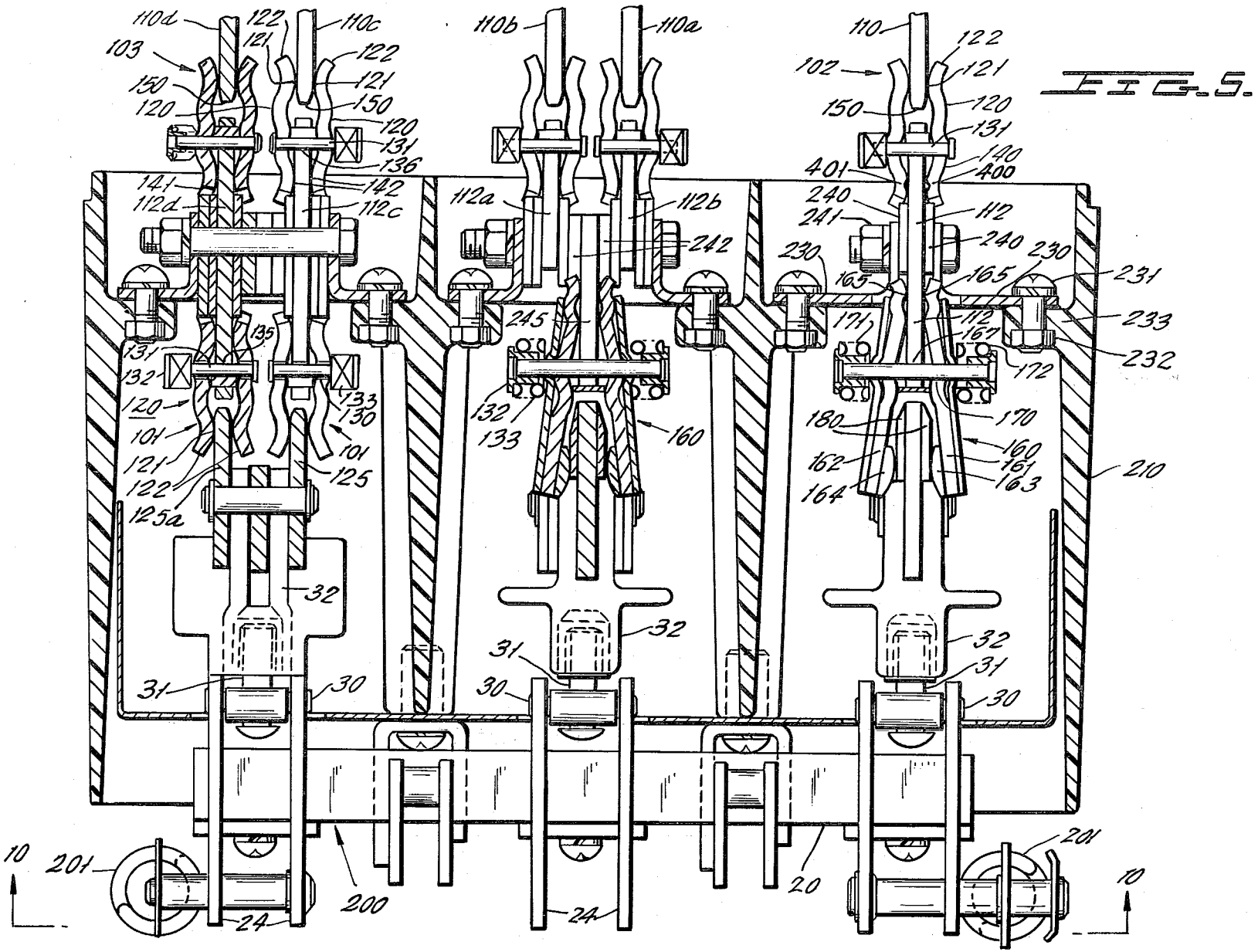

FIG. 5 is a top view partly in section taken from line 5—5 of FIG. 3 looking in the direction of the arrows. The left hand pole shows the main contact structure; the right and center poles show the arc contact structure.

Figure 6:
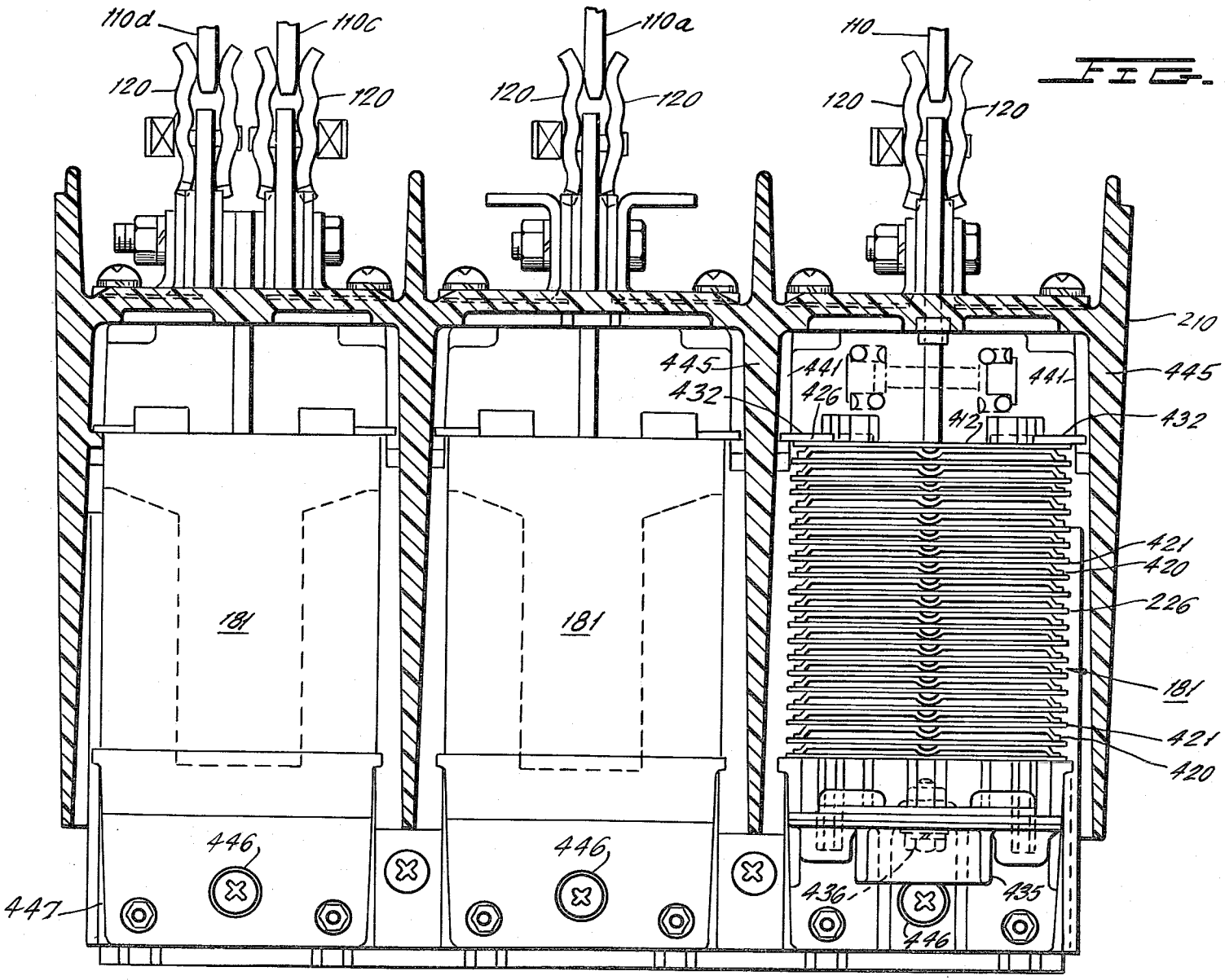

FIG. 6 is another top view partly in section taken from line 6—6 of FIG. 3 looking in the direction of the arrows.

Figure 7:
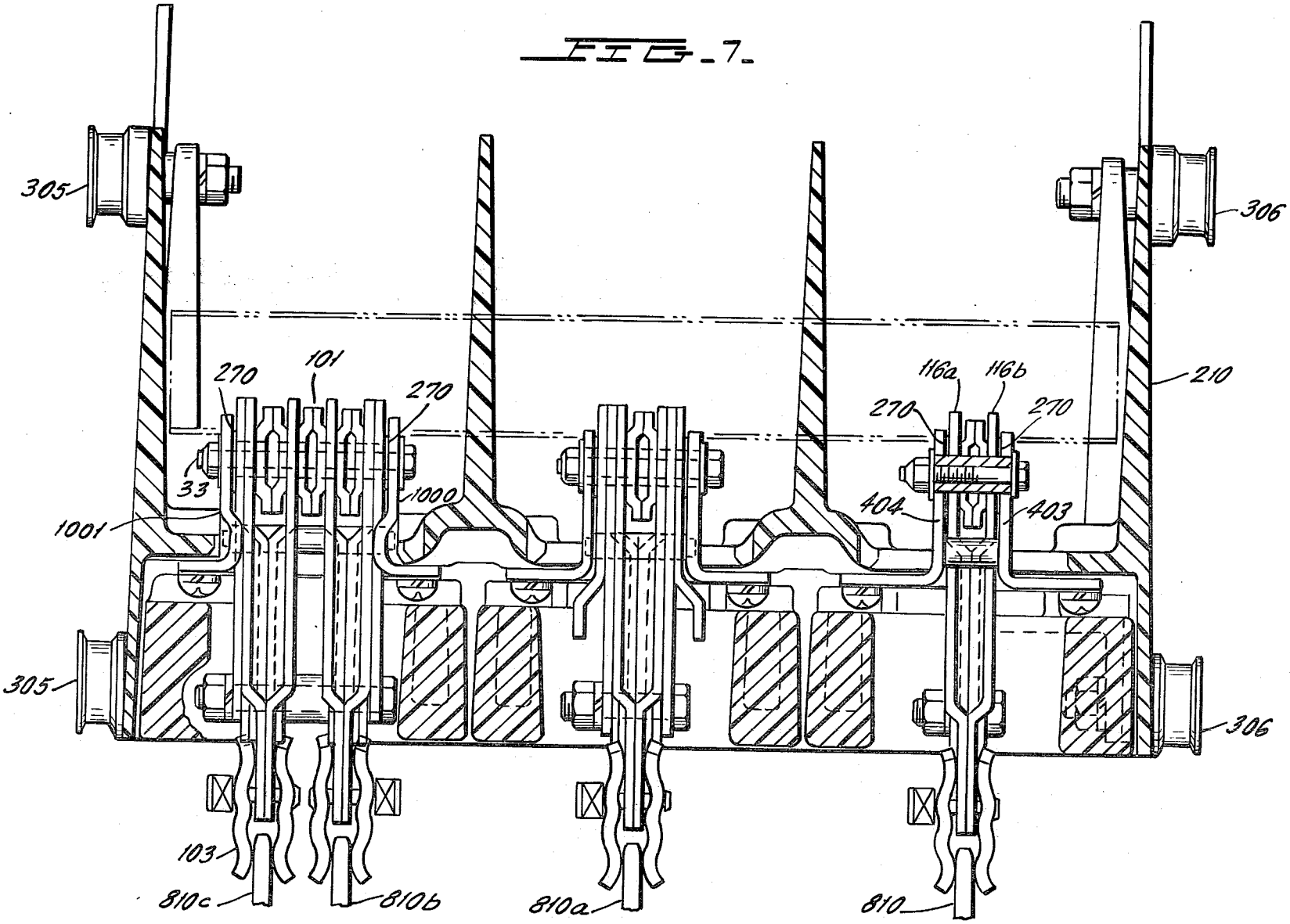

FIG. 7 is a horizontal view partly in section taken from line 7—7 of FIG. 3 looking in the direction of the arrows.

Figure 2:
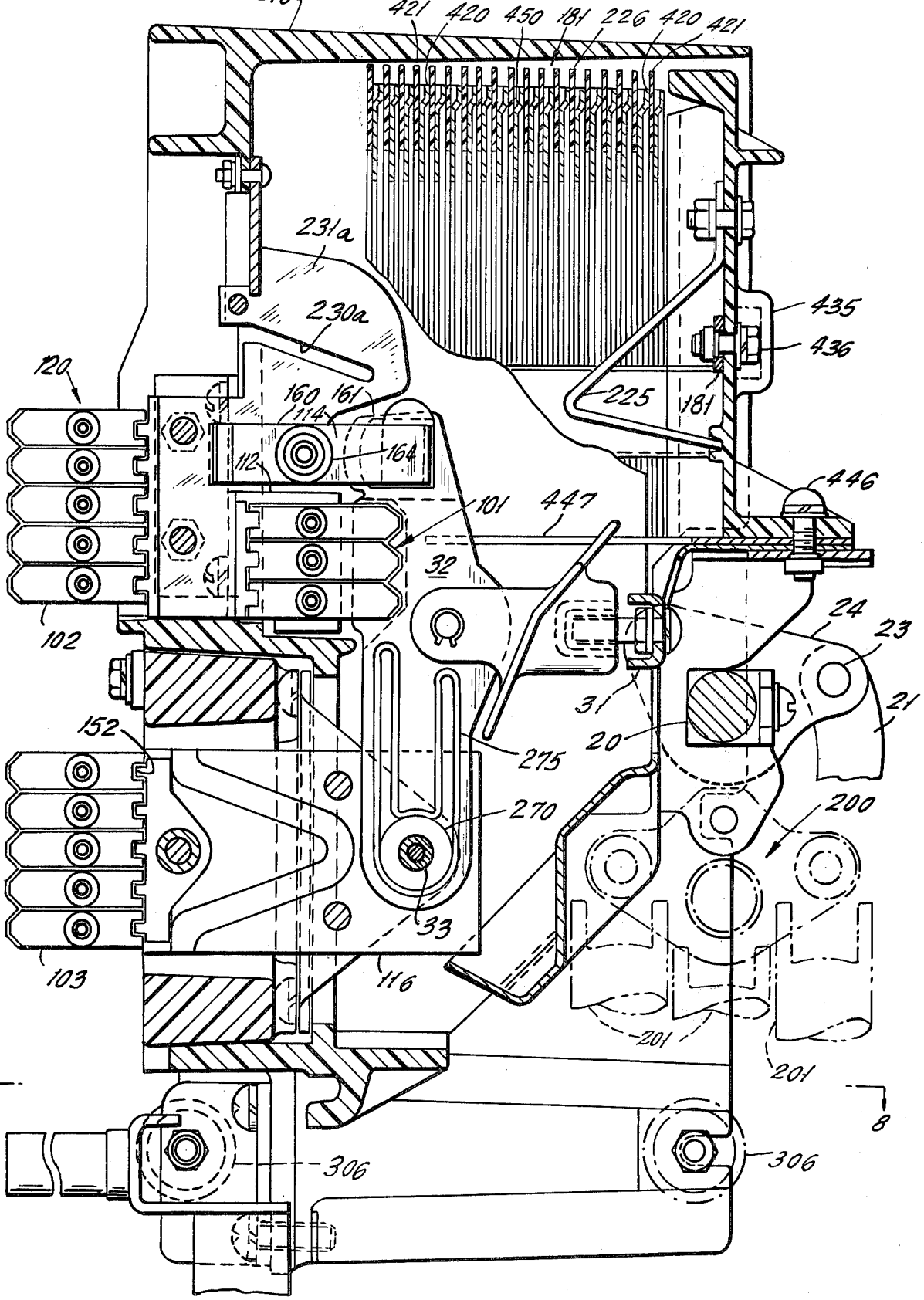
FIG. 2 is a side view partly in section corresponding to that of FIG. 1 showing in particular the stationary contact structure and corresponds to that of FIG. 1.
Figure 8:
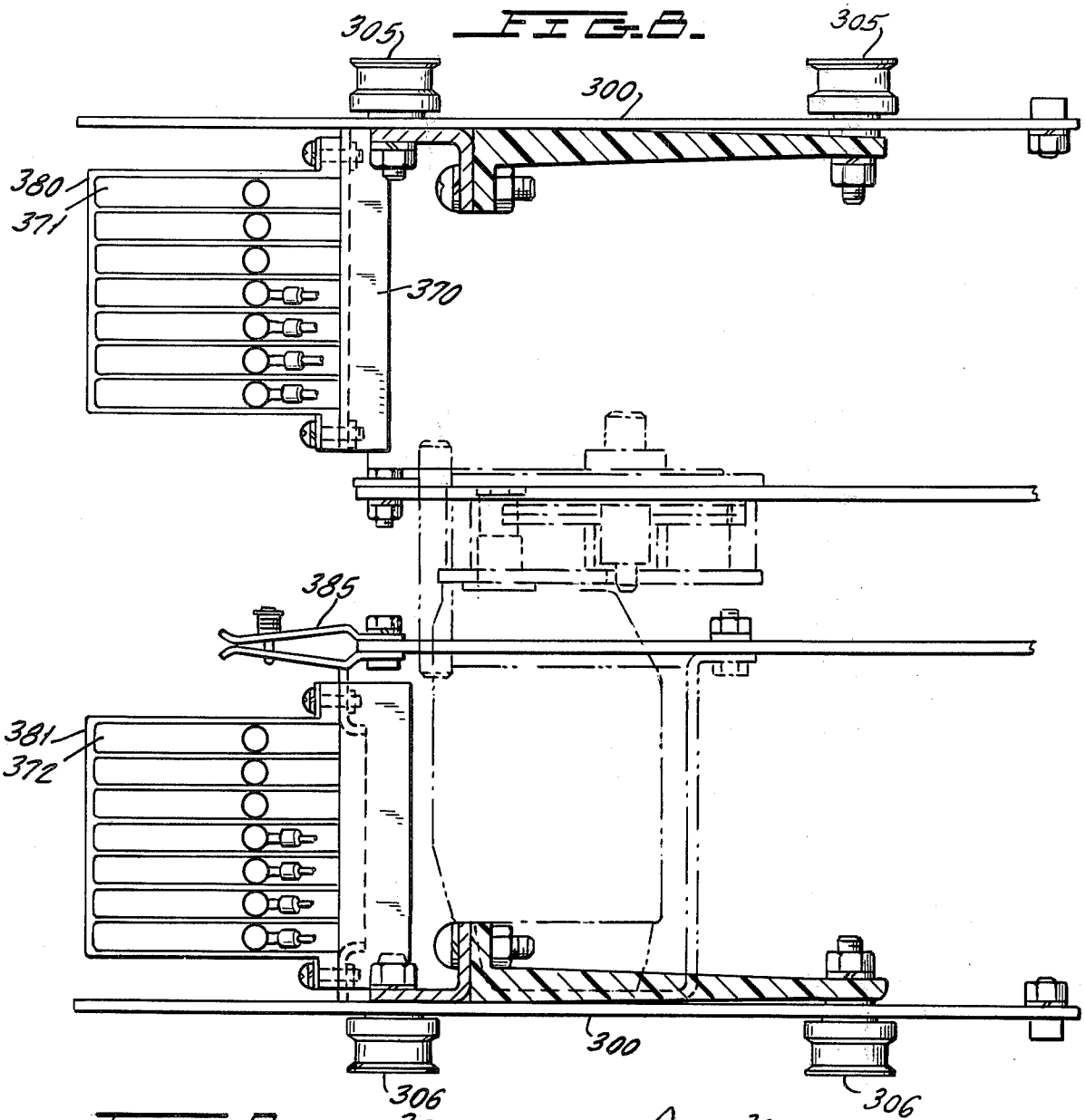

FIG. 8 is a top view of the control contact structure taken partly in section taken from line 8—8 of FIG. 2 looking in the direction of the arrows.

Figure 9:
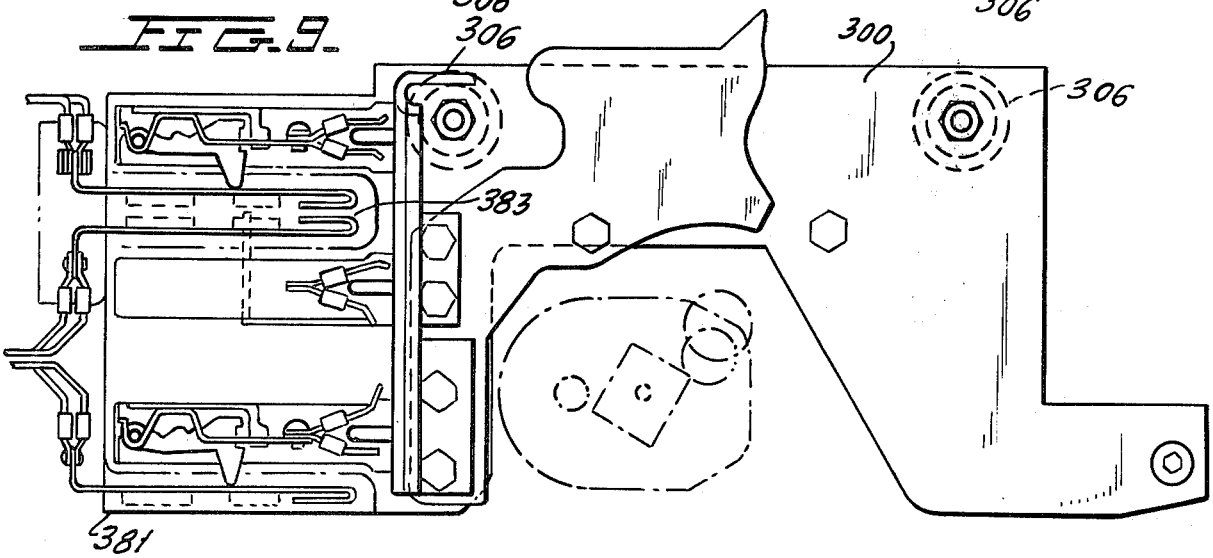

FIG. 9 is a side view of the control contact structure taken from the side of FIG. 8 and showing also the stationary control contact structure.

Figure 10:
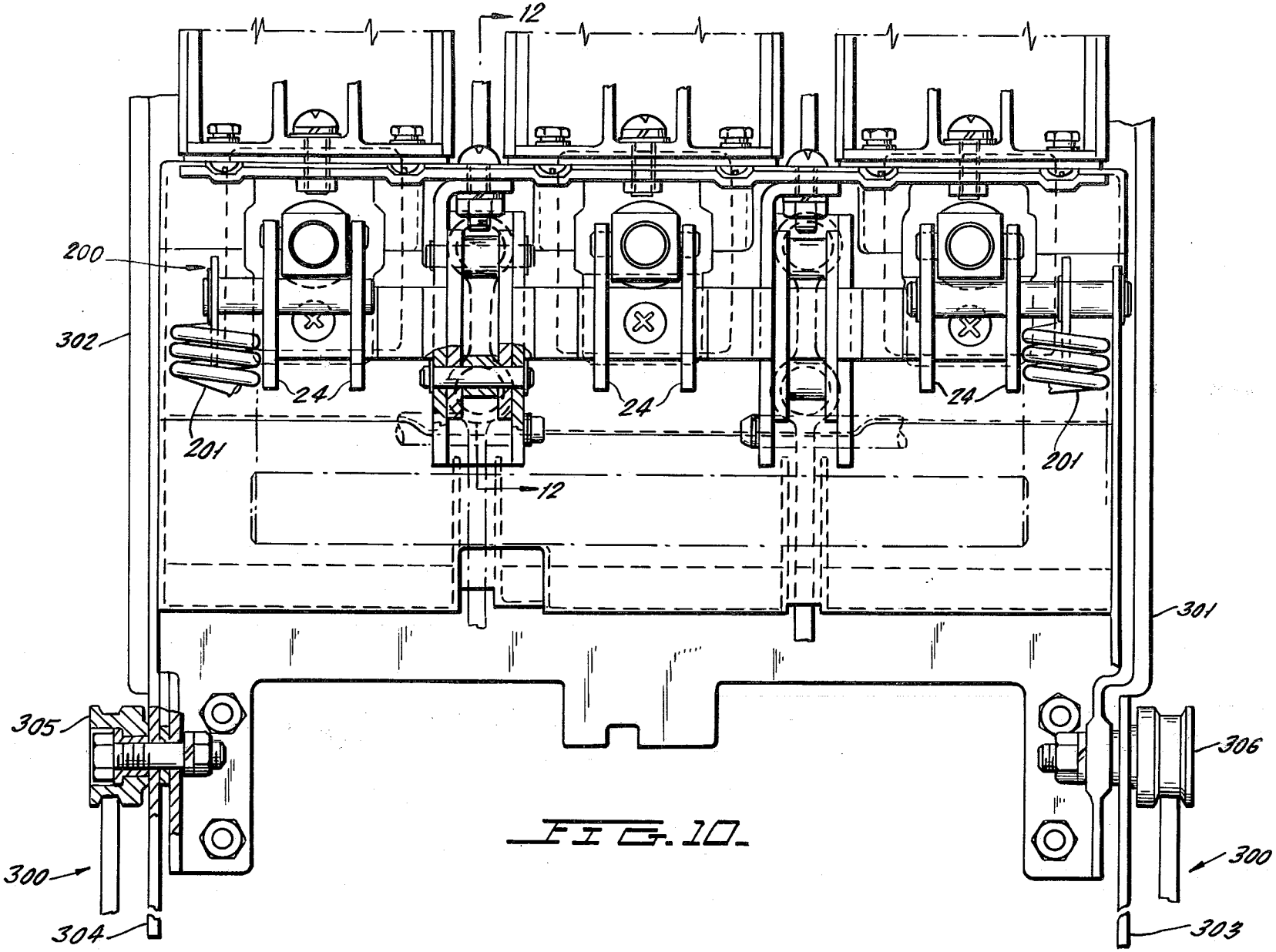

FIG. 10 is a front view partly in section taken from line 10—10 of FIG. 5 looking in the direction of the arrows.

Figure 11:
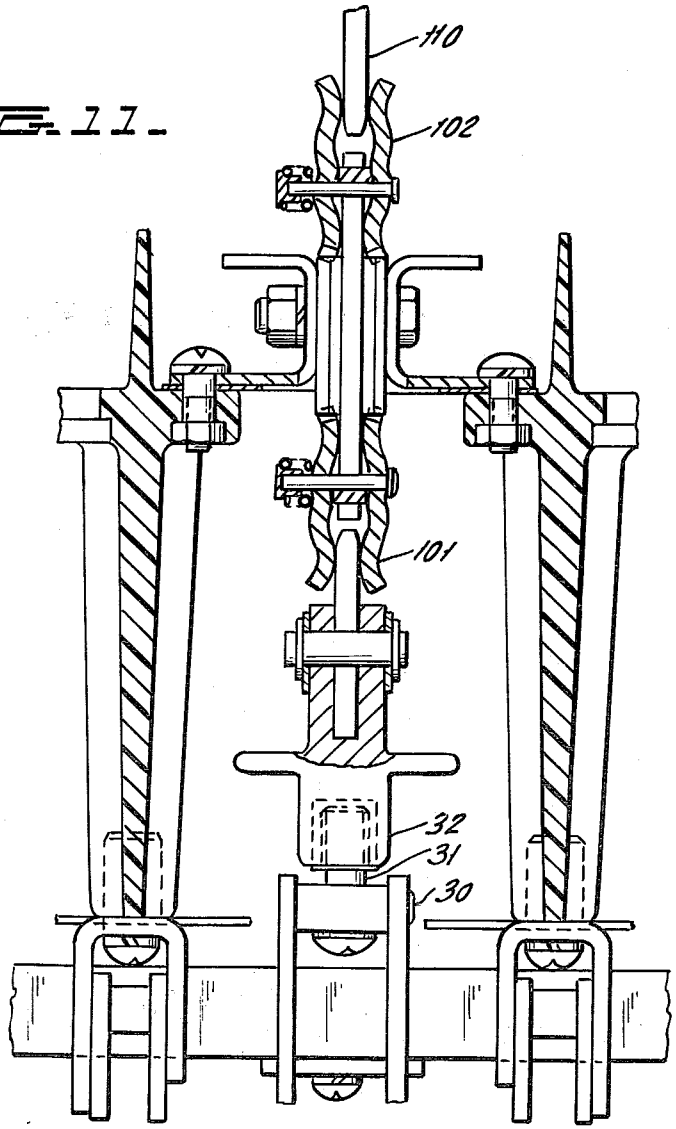

FIG. 11 shows a somewhat modified form of the main contract structure shown at the right-hand side of FIG. 5 in enlarged detail.

Figure 12:
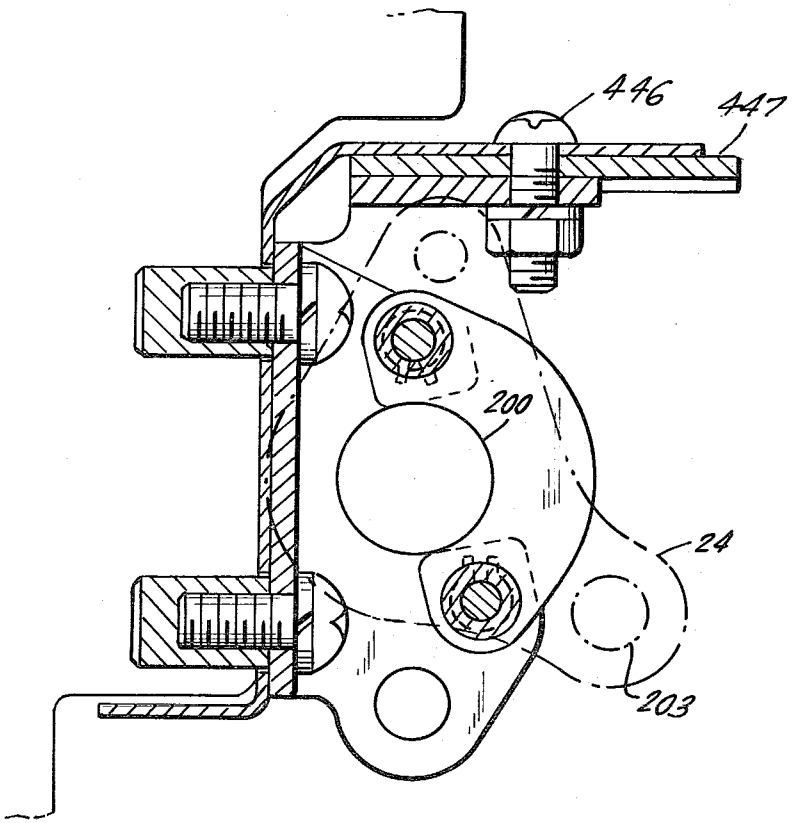

FIG. 12 is a view partly in cross-section taken from line 12—12 of FIG. 10 looking in the direction of the arrows.

Figure 1:
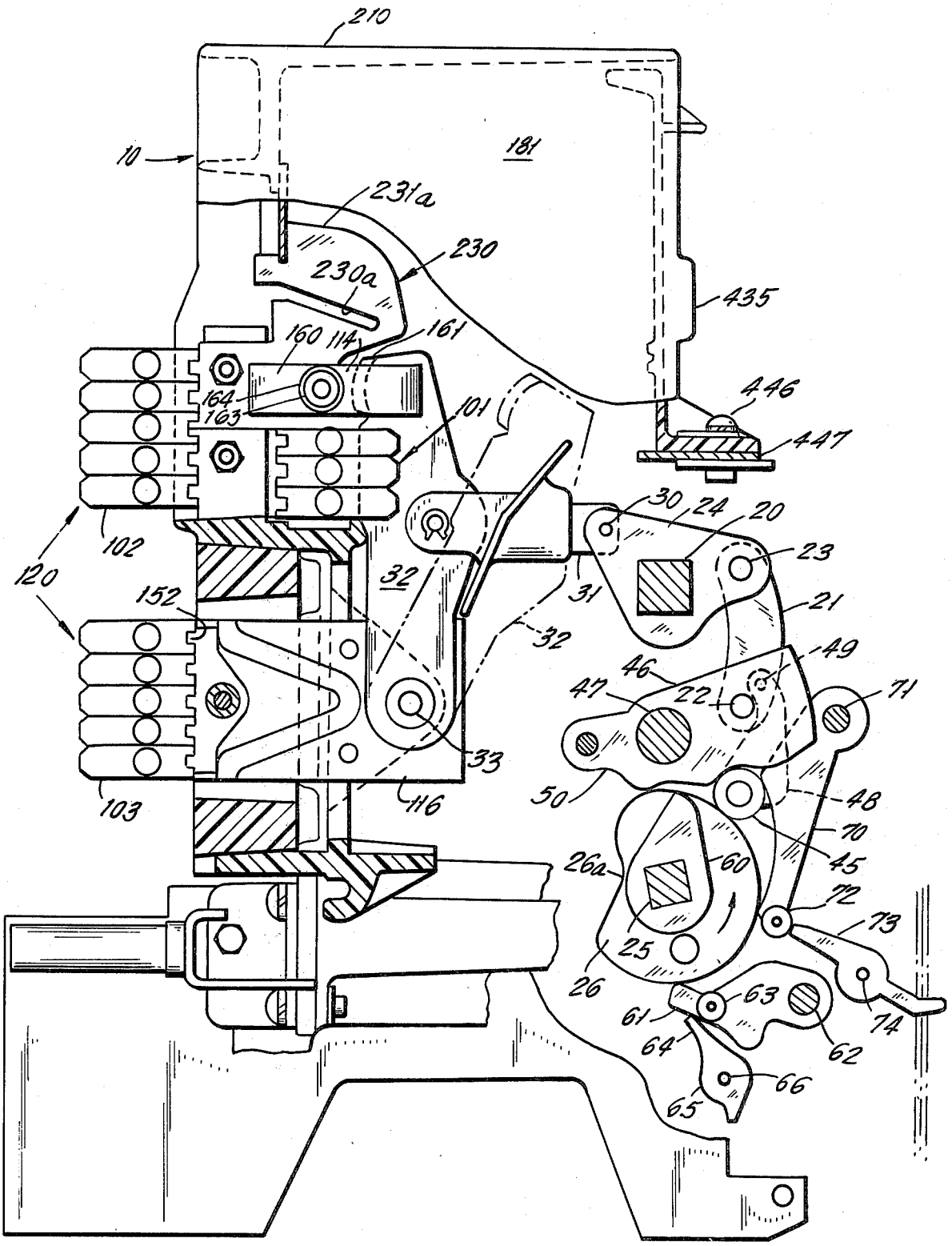
FIG. 1 is a schematic side view of the novel circuit breaker of the present invention showing one preferred arrangement of a contact member.
Figure 14:
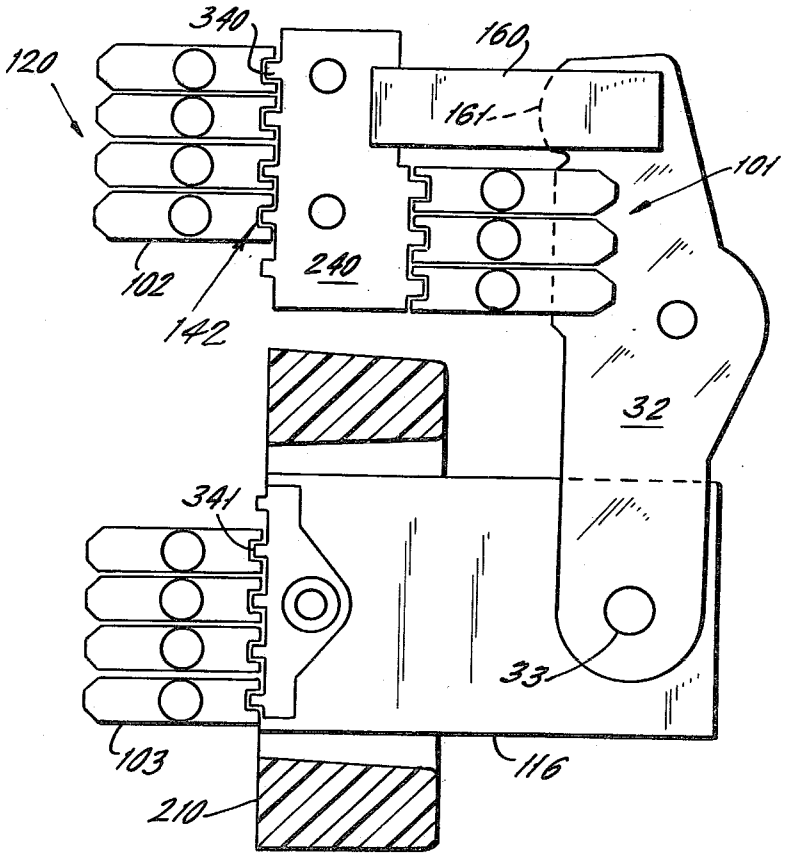
Figure 13:
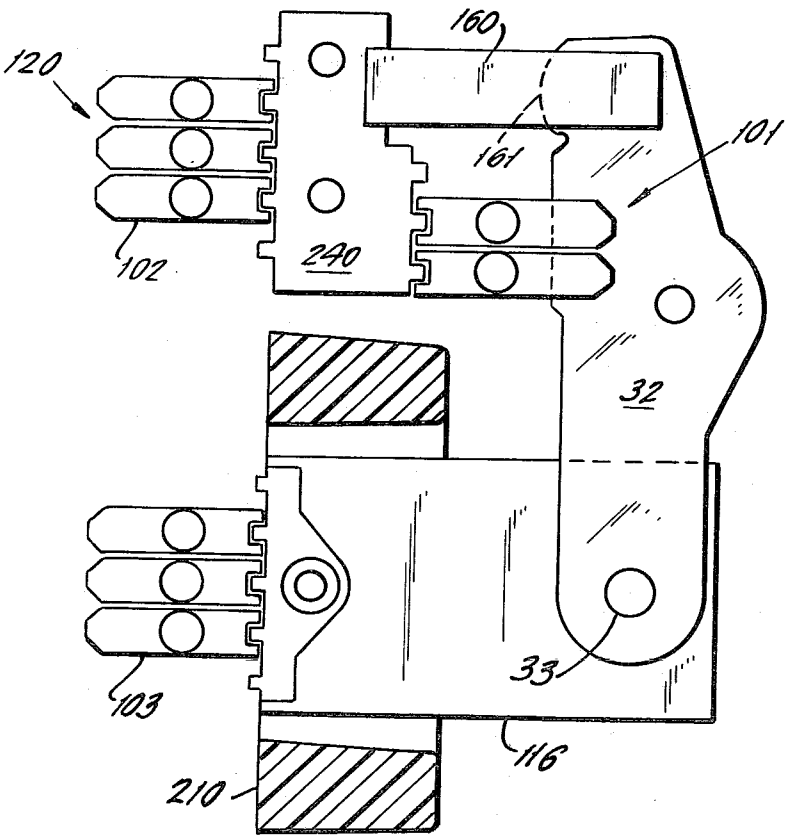

FIGS. 13 and 14 are schematic views corresponding in part to a portion of FIG. 1 showing alternate contact arrangements for various current capacities utilizing multiples of the same type of structure.

Referring first to FIG. 1, a circuit breaker is here shown schematically in the position in which the contacts are closed and the closing springs are fully discharged. The type of circuit breaker which is here referred to is fully described in copending applications assigned to the assignee of the present invention Ser. Nos. 735,017, 734,955 and 735,040, all filed Oct. 22, 1976), in which the basic circuit breaker to which this present application pertains is described in detail. The circuit breaker there described is a circuit breaker in which a plurality of closing springs are utilized to drive the circuit breaker from an open position to a closed position. Accordingly, a motor is provided which will first charge the springs and the springs are latched in the charged position. When the contacts of the circuit breaker are opened and are later to be closed, the latch which retains the closing springs in the charged position is released so that the springs may operate directly to close the contacts to the circuit breaker. After the contacts are closed, the springs may be recharged.

The present invention is directed to the circuit breaker structure itself and in particular, to the contact structure.

The spring charging structure and racking structure are therefore not specifically here described and the contact operating structure is described in connection with FIG. 1 to the extent only that it is necessary to understand the structure of the circuit breaker.

The shaft 25 is driven counterclockwise in the direction indicated by the arrow in FIG. 1 in order to charge the closing springs. For this purpose, an appropriate connection from a motor or handle is made to the shaft 25 to perform the operation. On the closing of the circuit breaker, an appropriate latch as described in the said prior applications is set to prop the basic support members while nevertheless leaving the circuit breaker trip-free but arranging the circuit breaker so that it will not accidentally be opened by the operation of the closing springs upon recharge. The closing spring can be discharged only when the breaker is open.

The latch member 60 carried by shaft 25 is driven onto the prop latch 61 in a position not shown in FIG. 1 (but shown in FIG. 5b of the prior application). The prop latch 61 is pivotally mounted on the stationary pivot 62 and is provided with the latch roller 63 which is supported by the closing latch 64. The closing latch 64 is an extension of the bell crank lever 65 which is pivoted on the stationary pivot 66. This latch structure provides a support for retaining the springs in charged condition while the contacts are open and after the contacts are closed preparatory to another closing operation.

In FIG. 1, the structure is shown in the condition in which the contacts are closed and the springs have been discharged; in other words, the closing latch 64 has been rotated so that it no longer supports the latch roller 63 and thus, no longer supports the prop latch 61 and thereby no longer supports the latch member 60 on the shaft 25 which latch member 60 has now rotated clockwise to the position where the springs have been discharged in order to close the circuit breaker. Therefore, the position shown in FIG. 1 is one in which the circuit breaker is closed and the springs are fully discharged.

As previously pointed out, the shaft 25 may be rotated in a counterclockwise direction to charge the springs, either by handle or motor, as described in the prior applications. Upon the discharge of the closing springs, which is the condition shown in FIG. 1, the shaft 25 is rotated to the position shown in FIG. 1, and the first cam 26 operates through roller 45 to rotate the third closing cam 46 in a counterclockwise direction around its pivot 47. The roller 45 supported on the arm 48 which is supported on the pivot 49 carried by the cam 46. The end of the third closing cam 46 opposite to that which is engaged by the roller 45 is provided with a recess 50 which engages an additional roller related only to the spring closing operation, and described in the prior applications and need not be described here.

The second closing cam 70 is stationarily pivoted on the pivot 71 and is provided with the latch roller 72 which bears against the tripping latch 73 rotatably mounted on the pivot 74 and spring biased toward the position shown in FIG. 1. Thus, as the springs are charged, shaft 25 is rotated counterclockwise until member 60 is blocked by the prop latch 61 when member 60 is in a position 180° opposite to the position shown in FIG. 1.

The prop latch 61 is in turn supported by the engagement of the latch roller 63 with the closing latch 64. This, again, is the condition when the closing springs are fully charged.

In the condition of the circuit breaker with the contacts open and the springs charged, the dwell or recess 26*a* of cam 26 on shaft 25 engages the roller 45. The roller 45 is driven up onto the outer perimeter of cam 26 thereby raising the third closing cam 46 around its pivot 47 and following a path defined by the cam 26 and the second closing cam 70. The engagement of latch 73 with latch roller 72 establishes the position of cam member 70 and the track for roller 45 so that roller 45 is guided in a path which will lift the third closing cam 46 around the pin 47. Link 21 connected at 22 to the third closing cam 46 is connected at 23 to the bell crank arm 24 secured on the jack shaft 20. The opposite end of bell crank arm 24 is connected by pin 30 to the extension 31 of the contact arm 80. It will here be noted that the contact arm 80 is maintained in the closed position by the latch 73 engaging the roller 72 and positioning the roller 45 and arm 48 so that the third closing cam 46 is maintained in the raised position to drive the bell crank lever 24 counterclockwise in the direction to maintain the contact arm 80 closed.

The essential element of the present invention relates to the contact arm 80, the main set of stationary contacts 101 engageable by the contact arm 80, which is a blade, the upper back disconnects contact 102 and the lower back disconnects contact 103.

The contact elements forming the contacts 101,102, 103 are arranged so that the main stationary contact elements 101 and the main disconnect contact elements 102, 103 are identical in construction thereby eliminating the total number of different parts which must be fabricated in order to construct the circuit breaker.

In the instance illustrated in FIGS. 1 and 2, the stationary contact 101 is shown with three pairs of jaws while the disconnect contacts 102, 103 are shown with five pairs of jaws. The number of pairs of jaws utilized for the contact elements depends on the current rating and the desired current carrying capacity. Thus, in FIG. 4 which is a rear view of the circuit breaker, it will be seen that in the case of, for instance, an 800 ampere circuit breaker, three pairs of jaws may be used for the upper and lower disconnect contact. Should it be desired to use a 1600 ampere circuit breaker, then the same general structure may be utilized with five pairs of contact jaws for the upper and lower disconnect contact.

Should a larger capacity breaker be required, such as a 2000 ampere breaker, then two sets of upper and lower disconnect contacts having five pairs of jaws each may be used for the purpose.

It should be noted in FIGS. 3, 4 and 5 while circuit breakers of different capacities are shown mounted in the three-pole structure, in any particular use, the circuit breaker structures for each of the poles should be the same in capacity. The showing of circuit breakers of three different capacities mounted in the three different sections of a single three-pole circuit breaker in FIGS. 3, 4, 5, 6 and 7 is for the purpose of demonstrating that the same housing and the same structure may be utilized for circuit breakers of varying capacity, both in their operating capacity such as the 800 ampere, 1600 ampere, 2000 ampere breakers, as well as in current interrupting capacity.

As seen particularly in FIG. 5, current enters through the upper back connection stud 110 in the cubicle or stationary part of the circuit breaker housing. In the case of a higher capacity circuit breaker, where a plurality of sets of disconnect contacts can be required, the back connection structure or terminal may be modified as shown at 110*a*, 110*b* to provide a double support for the contacts. Similarly, for an even larger capacity circuit breaker carried by the same structure, a somewhat heavier back connection terminal or stud 110*c*, 110*d* may be utilized. Current then passes (FIGS. 1 and 2) through the disconnect contacts 102 to the stationary contact support structure 112, then through the stationary contacts 101 and the stationary arcing contact 114 to the movable contact arm or contact bridge 32 which is pivotally mounted at the pivot 33 on the lower connector and contact mounting structure 116. The method of current carrying interconnection between the movable contact arm 32 and the lower back connection member 116 will later be described in detail.

Current then passes through the lower disconnect contacts 103 to the stationary terminal or stud 110 (FIG. 5) in the housing.

The disconnect contacts 102, 103 and the stationary contacts 101 are so arranged that they are identical in construction so that each member of the pairs of jaws forming the plurality of contact elements is identical. This, therefore, simplifies the fabrication of the circuit breaker elements. Each of the individual elements 120 forming the various contacts 101, 102, 103 as shown in FIGS. 1, 2, 3, 5 and 6 is composed of a substantially elongated member having from the side view (visible more clearly in FIGS. 1 and 2), a substantially elongated rectangular appearance, and from the top or edge view, seen more particularly in the upper end of FIGS. 5, 6, and 7, a plurality of curvatures designed to provide appropriate hinging contact pressure on the contact surfaces. Thus, as seen, for instance, in the view of FIG. 5, each of the contact elements 120 is provided with a separable contact surface 121 adjacent the end 122 thereof. The end 122 thereof bends or flares flatly away from the contact surface 121 thereby providing a pivot with respect to which the contact members 120 will move. It should be noted that with respect to the disconnect contacts at the rear of the circuit breaker, as shown in the lower portion of FIG. 5, the pair of members 120 facing each other also have their contact surfaces 121 facing each other and the flare at the end 122 provides easy entry of the stationary cubicle stud 110*c* between the contacts surfaces 121 of the respective contacts elements 120.

In FIG. 5 the fixed end of contact element 120 has two closely adjacent curvatures (400 and 401) for making contact with bus 112. The projections toward the ends of the element 120 are normally in contact with bus 112. The projections toward the center of the element 120 normally have a slight clearance to bus 112. If stud 110 is misaligned with bus 112 the elements 120 will pivot on these projections to accomodate misalignment. The elements 120 will always center themselves with respect to bus 112 when not engaged by stud 110, because this is their natural equilibrium point with no unbalanced forces which result from misalignment.

At the stationary circuit breaker contacts 101, 101, the elements 120 are reversed so that the contact surface 121 of each of them is directed toward the blades 125, 125*a* of the movable bridge or contact 32. This, again, provides easy access of the contact elements 125, 125*a* through the flared section formed by the elements 122, 122 of the stationary contact elements 120 between the said contacts.

The members 120 extend in one direction of the circuit breaker toward the rear of the circuit breaker for easy connection to the stationary cubicle contacts 110 while they extend in the opposite direction on the circuit breaker toward the front of the circuit breaker for easy connection to the movable contact structure 32.

Each of the members 120 is provided with an opening 130, 130 through which a bolt 131 may be passed and an appropriate nut 132 on the bolt 131 compresses a spring 133 in order to provide appropriate contact pressure between two matching members 120 the contact surfaces 121, 121, each of which is being driven toward the other. The bolt 131 also serves to mount the contact structure for the stationary contact of the circuit breaker on the connection member or circuit breaker internal bus 112; opening 135 is provided at the forward or right-hand end of the circuit breaker internal bus 112 (see FIG. 5), so that the bolt 131 may pass therethrough and secure the contacts in place. Similarly, at the rear end of the internal bus 112 of the circuit breaker, an opening 136 is provided for the rear bolt 131 in order to secure the contact members for the disconnect contacts 102 in place.

It will be noted that each of the contact members 120 is provided with an outwardly directed bend or boss 140 at the point where the bolt 131 passes through the same and that the contact elements 120 are so curved that the compression spring between them forces the contact sections 121 toward each other and also forces the stationary contact sections 142, 142 toward each other for current carrying engagement with the internal circuit breaker bus 112.

The contact members 120, 120 being driven toward each other by the compression spring 133 not only drive the contact surfaces 142, 142 into engagement with the internal circuit breaker bus 112, but also drive the contact surfaces 121, 121 of the contacts 120 toward each other in order to establish appropriate contact with the stationary or cubicle stud 110.

The flare provided by the bending out of the ends 122 at each end makes it possible when the circuit breaker is inserted into the cubicle for the contact surfaces 121, 121 of the contact 120 facing toward the rear to be spread apart by the chamfered end 150 of the stationary stud 110 to enter upon the surface of the stud 110 on each side and the compression spring establishes appropriate contact.

Similarly, in the reverse condition of the contact elements 120, the stationary circuit breaker contacts 101 operate in the same manner so that the blades 125, 125*a* may enter between the contact surfaces 121, 121.

For ease in assembly of the circuit breaker contact and in order to avoid misalignment during assembly, as seen particularly in FIGS. 1 and 2, and also in the lower end of FIG. 5, the contact members 120 are notched at their rear or "stationary" end at the notch 152 to indicate readily which part of the contact structure is to be stationarily and permanently secured to the contact carrying member.

In addition to the stationary contacts 101 described in connection with FIGS. 1, 2 and 5, the circuit breaker upper connection bus 112 carries an additional pair of arcing contacts 160 which engage with the arcing contact section 161 of the contact bridging arm 32. This arcing contact section is more readily seen in the upper right-hand and center poles of FIG. 5 wherein the stationary arcing contact 160 operates in substantially the same manner as one of the elements 120 of the main contact 101 or disconnect contacts 102, 103, except that it is larger and constructed to resist the effects of the arc.

The stationary arcing contact 160 comprises two identical contact members 161, 162, which are arranged to face each other and have at the end thereof, facing the movable contact arm, arcing contact elements 163, 164. The opposite end of the arcing contact members 161, 162 are provided with contact surfaces 165, 165, which engage the upper internal bus 112 of the circuit breaker leading to the upper disconnect contact section 102.

An opening in the upper 167 internal bus 112 of the circuit breaker carries the bolt 170 which passes also through appropriate openings in the arcing contact elements 161, 162, and positions compression springs 171, 172 on each side against the arcing contact elements 161, 162, thereby driving them toward each other and against the movable arcing contact 180, 180, carried by the contact bridging arm 32.

As is well known in the circuit breaker art, and as may well be readily seen, particularly from FIGS. 1 and 2, the length of the stationary arcing contact 160, and the arrangement of parts is such that, when the movable contact arm 32 moves from the solid line position of FIG. 1 to the dotted line position of FIG. 1, current is transferred from the stationary main contacts 101 to the stationary arcing contact 160. This is so because the separation of the movable contact arm 32 and the stationary circuit breaker contact 101 occurs first.

The arc is then drawn between the arcing contact elements 163 and 180 and is then moved up appropriately into the arc chute 181 where it is extinguished.

In FIG. 2, the circuit breaker mechanism including the shaft 20 which operates the moving contact arm 32, is shown as well as the operating link 21. There is also indicated at 200 the elements related to the spring charging mechanism for the charging of the springs 201, 201. No specific description of this structure is herein contained because it is described in the prior pending applications previously mentioned (Ser. Nos. 735,017, 734,955, and 735,040, all filed Oct. 22, 1976), and therefore requires no further specific description here. The molded frame 210 is also shown particularly in FIGS. 3, 4, 6 and 7, but is described in detail in the application entitled "MOLDED HOUSING FOR MAIN CONTACTS DISCONNECT CONTACTS AND ARC CHUTE" Ser. No. 869,589, filed simultaneously herewith by the same inventor and assigned to the same assignee. Similarly, the arc chute 181 is not described in detail herein because it is described in complete detail and claimed in a copending application Ser. No. 869,858, by the same inventor for Arc Chute, assigned to the same assignee and filed simultaneously herewith. Similarly, the cradle or carrier 220 of the circuit breaker is not described in detail in this application because it is described more specifically in the copending application, Ser. No. 869,777, for Circuit Breaker Cradle, by the same inventor and assigned to the same assignee also filed simultaneously herewith.

The trip member for the circuit breaker comprising both the trip and undervoltage package is not described in detail herein or shown because it is described and claimed in application for Circuit Breaker Trip and Undervoltage Structure Ser. No. 921,829, by the same inventor and assigned to the same assignee filed simultaneously herewith. Also, the specific racking mechanism of the present circuit breaker is not specifically described herein owing to the fact that it is described in application for Compact Racking Mechanism for Circuit Breaker, Ser. No. 869,588, filed simultaneously herewith as a further improvement of application Ser. No. 734,955, filed Oct. 22, 1976.

It is sufficient to note for the purpose of the present application that with respect to the arc extinguisher shown in FIGS. 2 and 6, as the contact arm 32 moves to the dotted line position of FIG. 1 and the arcing contact 161 is aligned with the arc runner 225, the movement of the arc between the plates 226 thereof serves to extinguish the arc. It may be noted that the magnet path provided by the notch 230*a* in extension 231*a* mounted on the circuit breaker bus 112 will be sufficient to provide additional magnetic flux if required to drive the arc into the arc chute. As is well known, the arc itself forms a half turn current loop which has an effect of blowing the arc up into the arc extinguisher apart from any additional magnet forces which may be involved.

In FIGS. 13 and 14, various combinations of contact members have been shown: FIG. 13 shows a relatively small number of contact members for a lower capacity circuit breaker. FIG. 14 shows a larger number of contact members for a larger capacity circuit breaker. It will be noted that even in the larger capacity circuit breaker arrangement of FIG. 14, there is room for additional circuit breaker contact elements and for disconnect contact elements in order to provide even greater additional current-carrying capacity. Notches 142 identify a particular end of the contact 120 so as to make certain that the contact members 120 are all assembled in the proper order.

The projections 340 serve to align the contact fingers 220 so that they do not pivot about the single bolt 131 holding them to the terminal.

The bus 112 of the circuit breaker is secured to the circuit breaker frame as shown particularly in FIG. 5, by the angle brackets 230 on each side. These angle brackets 230 are secured by appropriate bolts 231 and nuts 232 to a lip 233 of the molded frame 210 described in detail in another application filed simultaneously herewith and above referred to. A conductive pad 240 is mounted between the legs of the angle bracket 230 on each side and the upper bus 112 in order to provide additional current carrying section for the bus 112. This pad 240 is mounted between the legs of the angle bracket 230 and held in place by the bolt and nut arrangement 241, which now serves to secure the bus 112 to the main frame and to position it accurately with respect thereto. This structure is repeated for the lower bus 116. It is also used for the type of structure in which a plurality of buses 112 are used as shown in the middle and left-hand side of FIG. 5. Where the plurality of buses are thus used, then as shown in the middle and left-hand structures of FIG. 5, additional spacer pads 242, 242, are provided: these are, of course, conductive pads. The two elements 112*a* and 112*b* of the bus structure of the central circuit breaker are at the same potential; they also support between them an additional current-carrying extension 245 on which the arcing contact structure 160 is mounted in the manner already previously described.

In the case where the contact arm is provided with a pair of jaws 125, 125*a* as shown in the left-hand part of the structure of FIG. 5, then similar pads 242 may be used for the purpose of providing appropriate spacing and also to support the elements 112*c*, 112*d*, of the bus, in order to support the contact structures *101*, *101*.

It will thus be seen that for the smaller capacity circuit breaker an angle element 230 having a longer base leg will be used than for the larger capacity circuit breakers of the middle and left-hand side of FIG. 5.

However, the essential and salient fact with respect to the circuit breaker structure is that, irrespective of the capacity of breaker, it is possible to use the same types of members for the arcing contacts 116 and for the main stationary contacts 101 and for the disconnect contacts 102, 103, building them up from a series of multiple structures in order to achieve the final desired structure having the desired capacity.

It will be noted, particularly in FIG. 3, that the movable contact blade 32 is mounted on the pivot 33 in such a manner as to ensure efficient transfer of current to the contact blade 32. It is important of course to transfer current appropriately from a movable contact arm 32 at the pivot 33 to the lower circuit breaker bus 116 which supports the disconnect contacts 103 seen particularly in FIG. 3. For this purpose, as seen particularly in FIG. 3, the contact blade 32 at the pivot 33 is provided with appropriate pressure elements in order to achieve this result. The lower bus 116 is a two-piece member consisting of the elements 116a and 116b secured together in any appropriate manner. The contact arm 32 is a stamping consisting of two vertical members 261, 262 which are secured together to form the single contact arm and may be appropriately integrated at the upper end adjacent the movable contact-carrying end. The lower end of the sections 261, 262 of the contact arm are embossed outwardly at 263, 264. The pivot pin 33 is a bolt inserted through the sections 116a, 116b of the lower circuit breaker bus 116 and pulled up tight by the nut 265. This provides, because of the embossment at 263,264, a high-pressure contact pressure point for the connection between the movable contact arm 32 and the lower bus 116. This same type of structure may be used as shown at the center of FIG. 3 for a larger capacity circuit breaker 32a, 32b, in which the movable contact arm consists of arms 32a, 32b and the additional arm 32c to carry the arcing contact 161.

In the case of the circuit breaker structure at the left-hand side of FIG. 3, where three arms 32a, 32b, and 32c are used, each of the arms is split in the same way and the lower back connection structure including the bus 116 is divided into sections 116e, 116f, 116g, 116h, in order to provide an appropriate connection exactly the same as that described in connection with the embossments 263, 264 on the right-hand side of the circuit breaker. Appropriate spring washers 270, FIG. 7, may also be used between fixed support members 403, 404 and elements 116a and 116b at the pivot 33 in order to provide additional resilient compression. Stiffening ribs 275 are provided in blades 32.

The lower terminals engaging the member 116 have been described in detail with respect to FIG. 3. They are more clearly visible, however, in FIG. 7. In FIG. 10, the circuit breaker support structure which permits the movement of the breaker as a whole into and out of the circuit breaker cubicle is more clearly shown in front view. In this case, the breaker molding 301 is provided with side members 303, 304, which support the wheels 305, 306. These wheels roll on stationary tracks 300 and permit the breaker to be readily moved into and out of the cubicle. The cradle tracks 300 through the wheels 305, 306 also support the breaker molded casing 210 (FIGS. 2 and 3) as well as the auxiliary contact structures 320, 321, 322, as seen in FIGS. 4, 8 and 9.

It should be noted that the pads 240 (FIG. 14) extending on either side of the studs or buses 112, 116 are provided with extensions 340, which receive the notches 341 of the contact elements thereby further ensuring appropriate orientation of the contact elements 120 and further guidance and control of the position thereof. It will be seen from FIGS. 8 and 9 that the control contact structures are mounted on the cross bar 370. The control contact structures comprise a plurality of contact elements 371, 372 in different groupings 380, 381 in order to inter-engage with appropriate contacts in the cubicle. The contacts 371, 372 cooperate with appropriate aligned stationary contacts 373 in the cubicle to establish appropriate controls. Similarly, the auxiliary contacts 385 align with the appropriate stationary contacts not shown in the cubicle for further establishment of control circuits. These control circuits are established for the usual purposes of providing appropriate indications of the various positions of the circuit breaker. FIG. 12 shows the jack shaft structure 200 for the closing spring operation.

One of the principal features of the present invention is that the contact elements of the circuit breaker both for inter-engagement of contacts for opening and closing the breaker, as well as the disconnect contact elements of the rear of the breaker for connecting the breaker to stationary terminals in the switchboard, are so arranged that they may be built up from a member of identical contact pieces which can be stacked together in different numbers and in different arrangements depending upon the different ratings which the circuit breaker is to have.

This leads to the result that the main stationary contacts of the circuit breaker and the disconnect contacts of the circuit breaker are so arranged that they are identical in structure or at least identical in the components from which they are built up, thereby minimizing the total number of parts which may be required even in the manufacture of the circuit breaker.

Another important feature of this invention is in the structure of the main contact and arcing contact arm where the arm is formed of two conductive plates, both of which are stamped. The plates have adjacent bosses to form a washer-type action; that is, the bosses are so arranged that when they are forced to bear against a contact-carrying member by a bolt passing through them, better contact is made to the moving contact arm, thereby also eliminating the need for any pigtail.

Another important feature of the present invention is the utilization of a contact arm consisting essentially of three bridging arms, the two outer arms and the central arm being interconnected to the two outer arms constituting the main contact blade and the central arm carrying the arcing contact.

The contact elements themselves from which the main stationary contact of the circuit breaker and the disconnect contacts are built up are provided each with a contact spacing and biasing arrangement so that a pair of identical members may be used as a single jaw-type contact or part of a jaw-type contact made up of aligned pairs of identical members.

Appropriate curvatures are provided on the individual elements so that appropriate pivot points for the individual members on the bus or arm on which they are mounted are provided with a spring biased arrangement so that the jaws may be pivoted toward each other so that they may receive a contact blade or its equivalent.

Another feature of the present invention is the construction of a rear arc runner so that it uses two plates of the same type that are utilized for the movable contact arms. The two plates are clamped together in the same manner that the contact arm plates are clamped together, thereby simplifying the manufacture of the rear arc runner. This is so because thin plates on the order of one-eight inch thick can readily be punched whereas the one-quarter inch plates cannot be punched, but must be otherwise treated to create the necessary openings.

In the foregoing, the present invention has been described in connection with illustrative embodiments thereof. The essence of the invention is expressed in the claims.

I claim:

1. In a circuit breaker having a stationary contact structure and a complementary blade contact structure; said stationary contact structure comprising at least one pair of contact jaws; said blade being receivable in said jaws to establish current carrying connection between said blade and said jaws;

a current carrying bar in said circuit breaker;

means for connecting said pair of contact jaws at one end of said current carrying bar;

said pair of contact jaws each comprising an elongated member identical to each other, facing each other;

said means for connecting said jaws on said current carrying bar including further means biasing said jaws toward each other; one end of each of said jaws being biased into current connecting engagement with said current carrying bar;

the other end of each of said jaws extending beyond said bar and being biased toward each for effective current carrying connection to said blade when said blade is inserted therebetween;

and a second pair of contact jaws at the opposite end of said current carrying bar;

said second pair of contact jaws being mounted in the same manner as said first set of contact jaws and forming disconnect contacts for said circuit breaker;

said second pair of contact jaws being identical in structure and shape to said first pair of contact jaws and being mounted on said opposite end of said current carrying bar in the same manner as said first pair of contact jaws.

2. The circuit breaker of claim 1 in which an end of said contact bar is provided with a plurality of pairs of said contact jaws; each of the jaws of each pair being identical to the other jaws of the plurality of pairs.

3. The circuit breaker of claim 1 in which both ends of said contact bar are provided with a plurality of pairs of said contact jaws; each of the jaws of each pair being identical to the other jaws of the plurality of pairs.

4. The circuit breaker of claim 2 wherein the number of pairs of contact jaws may be selected in accordance with the current carrying requirements of the circuit breaker.

5. The circuit breaker of claim 3 wherein the number of pairs of contact jaws for each end may be selected in accordance with the current carrying requirements of the circuit breaker.

6. The circuit breaker of claim 1 wherein a stationary disconnect contact for the circuit breaker is provided; said second set of contact jaws engaging said stationary disconnect contact.

7. The circuit breaker of claim 6 wherein the mounting of each pair of contact jaws on said current carrying bar includes a bolt; an opening in said current carrying bar to receive the bolt;

openings in said pair of jaws through which the bolt may pass; and spring means carried by said bolt driving said jaws toward each other.

8. The circuit breaker of claim 7 wherein the portion of each jaw engaging said current carrying member is curved in a direction to enable it to rock with respect to said current carrying member;

said jaws being movable to accommodate possible misalignment of said disconnect contact with respect to said second pair of jaws.

9. The circuit breaker of claim 8; in which said jaws are movable to accommodate possible misalignment of said blade with said first pair of jaws.

10. The circuit breaker of claim 1 in which an additional current carrying bar is provided extending below and parallel to said first carrying bar;

said additional current carrying bar pivotally supporting said blade contact structure at the end thereof adjacent the said stationary contact structure;

said additional current carrying bar supporting a third pair of contact jaws below the said second set of contact jaws;

said third pair of contact jaws being identical in structure and shape to said first and second pair of contact jaws.

11. The circuit breaker of claim 1 wherein a plurality of contact jaws are used at each of the three contact jaws locations.

12. The circuit breaker of claim 11 wherein the number of pairs of contact jaws for each of the three contact jaws locations may be selected in accordance with the current carrying requirements of the circuit breaker.

13. The circuit breaker of claim 10 in which a stationary arcing contact is supported on the first mentioned current carrying bar above the first mentioned stationary contact structure; said blade contact structure having an extension above the portion thereof engageable by the stationary contact structure; and an arcing contact carried by said extension of said blade.

14. The circuit breaker of claim 10 in which said pivotal support for said blade comprises an opening in said second current carrying bar; a bolt in said opening; said blade being rotatable about said bolt; resilient members positioned by said bolt and driving said blade into current carrying engagement with said current carrying bar.

15. The circuit breaker of claim 14 wherein fixed support members are provided at the bolt location and said resilient members are placed between said fixed support members and said blade driving said blade into firm current carrying engagement with said second current carrying bar.

16. The circuit breaker of claim 10 in which said blade is bifurcated to form a pair of legs at the pivotal connection thereof to said second current carrying bar; said legs bearing against said second current carrying bar.

17. The circuit breaker of claim 16 in which said pivotal support for said blade comprises an opening in said second current carrying bar; a bolt in said opening; said blade being rotatable about said bolt; resilient members positioned by said bolt and driving said blade into current carrying engagement with said current carrying bar.

18. The circuit breaker of claim 17 in which said blade is bifurcated to form a pair of legs at the pivotal connection thereof to said second current carrying bar; said legs bearing against said second current carrying bar.

19. The breaker of claim 18 in which the first mentioned current carrying bar has a plurality of sets of stationary contact pairs of jaws; and in which a corresponding plurality of contact blades are pivotally supported on the second current carrying bar.

20. The circuit breaker of claim 19 in which the first mentioned current carrying bar has a plurality of sets of disconnect contact pairs of jaws; and in which a corresponding plurality of stationary disconnect contacts are provided.

* * * * *

UNITED STATES PATENT AND TRADEMARK OFFICE

CERTIFICATE OF CORRECTION

PATENT NO. : 4,160,142

DATED : July 3, 1979

INVENTOR(S) : Challiss I. Clausing

It is certified that error appears in the above-identified patent and that said Letters Patent are hereby corrected as shown below:

Please change the name of the inventor from:
"Charles I. Clausing" to -- Challiss I. Clausing --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*